US005080604A

United States Patent [19]

Rider et al.

[11] Patent Number: 5,080,604

[45] Date of Patent: Jan. 14, 1992

[54] SELF-ALIGNING ELECTRICAL CONNECTOR ASSEMBLY FOR FLAT POWER CABLE TERMINATIONS

[75] Inventors: Frederick H. Rider; David S. Szczesny, both of Glendale, Ariz.

[73] Assignee: AMP Incorporated, Harrisburg, Pa.

[21] Appl. No.: 612,945

[22] Filed: Nov. 13, 1990

[51] Int. Cl.[5] ..... H01R 13/627

[52] U.S. Cl. ..... 439/357; 439/492; 439/680

[58] Field of Search ..... 439/246, 247, 248, 350, 439/357, 358, 422, 495, 493, 492, 494, 496, 497, 498, 677, 678, 679, 680, 681, 701

[56] References Cited

U.S. PATENT DOCUMENTS

| | | | |
|---|---|---|---|
| 4,109,989 | 8/1978 | Snyder, Jr. et al. | 439/357 X |
| 4,433,880 | 2/1984 | Winger | 439/357 X |
| 4,664,456 | 5/1987 | Blair et al. . | |
| 4,812,133 | 3/1989 | Fleak et al. | 439/248 |
| 4,859,204 | 8/1989 | Daly et al. | 439/424 |
| 4,887,976 | 12/1989 | Bennett et al. | 439/492 |
| 4,915,650 | 4/1990 | Daly et al. | 439/498 |
| 4,921,442 | 5/1990 | Puerner | 439/499 |
| 4,944,693 | 7/1990 | Puerner | 439/358 |
| 4,975,080 | 12/1990 | Daly et al. | 439/422 X |

OTHER PUBLICATIONS

IBM Technical Disclosure Bulletin, vol. 16, No. 12, R. T. Evans, May 1974.

*Primary Examiner*—Neil Abrams
*Assistant Examiner*—Khiem Nguyen
*Attorney, Agent, or Firm*—Anton P. Ness

[57] ABSTRACT

An electrical connector assembly including integral means for self-alignment and adapted to be used with flat power cable having relatively wide terminals terminated thereonto. A polarizing system is provided complementary to said self-alignment which provides assured mating prevention upon improper connector polarizing orientation. One embodiment is adapted for rack and panel applications where one of the connectors is float mounted. Another embodiment is adapted for delatchably latching together of the connectors with low profile latch arms. A system of polarizing the assembly of terminated dual conductor cables in a housing is provided for control of the electrical connections of the two conductors of each flat cable, by using a polarizing projection on one of the two terminals on each cable, and a corresponding channel along the appropriate one the terminal-receiving cavities of the housing for passing of the projection upon proper cable orientation.

10 Claims, 7 Drawing Sheets

SELF-ALIGNING ELECTRICAL CONNECTOR ASSEMBLY FOR FLAT POWER CABLE TERMINATIONS

FIELD OF THE INVENTION

The present invention is related to the field of electrical connectors and more particularly to connectors for flat power cable.

BACKGROUND OF THE INVENTION

U.S. Pat. No. 4,915,650 discloses terminating a flat power cable having one (or two side-by-side) flat conductors with a pair of terminals crimped onto a slotted end thereof by penetrating the insulation covering the cable's conductor and also shearing through the conductor (or conductors) at a plurality of locations. The cable is of the type entering commercial use for transmitting electrical power of for example between 50 and 100 amperes nominal; the single conductor flat cable includes a flat conductor one inch wide and about 0.020 inches thick with an extruded insulated coating of about 0.004 to 0.008 inches thick over each surface with the cable having a total thickness of up to about 0.034 inches. Such terminals can also be used to terminate flat cable having two spaced flat conductors each 0.45 inches wide separated by a narrow median of dielectric material, instead of the cable having a single conductor. Each terminal has a pair of opposed plate sections transversely across each of which are termination regions containing an array of shearing wave shapes alternating with relief recesses, so that when the pair of plate sections disposed against major surfaces of the flat cable at an end thereof are pressed together and against the cable therebetween, the arrays of shearing wave shapes cooperate to shear the conductor of the flat cable into a plurality of strips which remain integral with the cable. The wave shapes also deflect the newly sheared conductor strips into the opposing relief recesses so that newly sheared conductor edges are moved adjacent electrical engagement surfaces defined by the vertical side edges of the adjacent shearing wave shapes forming electrical connections of the adapter terminals with the flat cable conductors.

The pair of plate sections of each terminal both extend forwardly from a rearward cable-receiving terminal end where they coextend forwardly at a slight angle from a pair of bight sections spaced laterally apart defining a cable-receiving slot therebetween. Tab-shaped portions are blanked on the end section of the cable and are inserted through the cable-receiving slots of the terminals to be disposed between upper and lower plate sections of each terminal. The upper and lower plate sections of each pair are pressed together, being rotated about the bight sections which act as integral hinges, so that the shearing wave shapes shear and deflect strips of the conductor (or conductors) of the cable forming a termination of the terminals to the cable.

The method of terminating is preferably as described in U.S. Pat. No. 4,859,204, and preferably the terminals are two-part assemblies of adapter members including the cable-adjacent terminal portions and the contact sections, and low resistance copper members fastened to the outwardly facing surface of each of the adapter members at their respective terminating regions. The inserts have terminal-facing surfaces conforming closely to the shape of the outer surface of the terminating region, with alternating wave shapes and apertures disposed outwardly of and along the adapter member's shearing wave shapes and relief recesses. Upon termination the wave joints are within the insert apertures, and the sheared edges of the adjacent conductor strips and of the terminal wave shapes which formed the sheared strips are adjacent to side walls of the copper insert apertures. A staking process is disclosed in which the sheared conductor strips and insert portions between the sheared strips are deformed against each other with the insert portions simultaneously being deformed against the adapter member's wave shape edges coplanar with the strip edges, forming gas-tight, heat and vibration resistant electrical connections with the cable conductor and with the terminal, so that the inserts are electrically in series at a plurality of locations between the conductor and the adapter.

A contact section is integrally included on the adapter member of such terminal assemblies enabling separable mating with corresponding contact means of an electrical connector and can include a plurality of contact sections to distribute the power to a corresponding plurality of contact means if desired or to define a plurality of electrical paths to a single corresponding contact means. The contact members of one of the connectors can be blade-shaped, while the contact members of the other comprise arrays of spring arms matable with the blade-shaped contact members under substantial contact normal force necessary for power transmission. Examples of such contact sections are disclosed in U.S. Pat. No. 4,887,976 and in U.S. Pat. Application Ser. No. 07/511,662 filed Apr. 20, 1990. A housing or other dielectric covering can be placed around the termination as desired.

In U.S. Pat. Nos. 4,915,650 and 4,921,442 there are disclosed a housing for a single flat power cable termination wherein the terminal-terminated end of the dual (or single) conductor flat power cable is inserted into the rearward end of adjacent wide, low profile housing cavities (or single cavity) for contact sections of the terminals (or terminal) to extend forwardly from or be exposed along the housing mating face. A rearward cover member is then securable to the rearward end of the housing such as by latching thereto, to secure the terminals within the cavities (or terminal within the cavity) and define a cable exit spaced rearwardly of the terminations of the terminals or terminal. The rearward cover member has two opposed struts joined at one lateral end to be inserted over the flat cable from one side, after which the rearward cover member is latched to the rearward housing end in a manner clamping the opposed struts together at the other lateral end and against the cable exiting the connector therebetween. The rearward cover member includes opposed arcuate recesses along forward inner surfaces of the upper and lower struts defining rearward stop surfaces cooperable with arcuate rearward bight sections of the terminals laterally adjacent the cable edges to maintain the terminals properly positioned axially within the housing, maintaining the contact sections in position axially to enhance wear resistance of the contact surfaces by minimizing axial movement thereof.

U.S. Pat. No. 4,664,456 discloses a variation of a generally conventional integral alignment system of matable electrical connectors, wherein the connectors are to be mated remote from the ability of a person to manipulate the connectors into an aligned angular orientation; one of the connectors may be fixedly mounted such as to a rack at the rear of a drawer-receiving slot, and the other is float mounted to the back panel of a drawer insertable into the drawer-receiving slot of the rack. In response to the initial bearing engagement of frustoconical leading ends of the pair of semicylindrical alignment posts with corresponding bearing surfaces of post-receiving apertures of the other connector, the float mounted connector is urged incrementally laterally and angularly into a precisely aligned orientation with the fixedly mounted connector, only after which do the contact terminals within the connectors engage and become electrically connected. Additional bearing surfaces of the connectors engage after the blade-shaped contacts to be mated coextend along each other, to cam the float mounted connector and its contacts in a selected direction laterally to urge the contacts into spring loaded engagement with the mating contacts for assured electrical engagement. A particular variation of a float mounting system is also disclosed, wherein a pair of shoulder screws extend through larger diameter mounting holes of the float mounted connector, permitting incremental movement sufficient to attain precision alignment during initial stages of connector mating, while elastomeric means urge the connector to a known position when unmated.

It would be desirable to provide a connector for one or more flat power cable terminations which is matable with another connector in a manner providing integral means for attaining accurate axial and angular alignment of the connectors prior to engagement of any portions of the contact members eventually to be mated together upon full connector mating.

It would be additionally desired to provide such mating connectors with integral means for assuring the axial and angular alignment of the thin, wide contact terminals after the respective housings have become aligned and the connectors have been moved farther together.

It would also be desirable for such connectors to provide integral means for stabilizing the positions of the terminals within the housings to resist movement when subjected to stresses and moments during mating and to stabilize the terminal positions and protect the integrity of the terminations to the flat power cables from stresses and torques transmitted to the connector by the flat cables at right angles therewith while permitting the contact terminals to become assuredly aligned during mating and remain aligned thereafter.

It would be further desirable to provide such connectors with an integral polarizing means to assure appropriate angular orientation prior to contact terminal engagement and full connector mating while assuredly preventing such terminal engagement and mating of the connectors when the connectors are not oriented at an appropriate angle.

SUMMARY OF THE INVENTION

The mating connector assembly of the present invention includes a pair of connectors defined by housings of dielectric material having terminal-receiving cavities within which are secured contact terminals. In at least one of the connectors are secured a pair of terminals terminated onto the ends of respective conductors of each of several flat power cables, or individual terminals terminated on the end of the conductor of each single conductor cable. The other connector may be a header mountable onto a printed circuit board and containing corresponding terminals electrically connected to conductors of the board, for example, or it may also contain terminals terminated onto conductor cables such as flat power cables. Contact sections of the terminals extend forward of the cavities and are thereby exposed along the mating faces of one of the connector housings for electrical contact with corresponding contact sections of the other connector when mated, and preferably the terminals terminated onto the flat power cable conductors include wide blade-shaped contact sections matable with wide arrays of spring arm contact sections of corresponding terminals of the other connector which may be a board header. A strain relief member is securable onto the rear face of each flat cable connector housing after the terminated cable ends are inserted into the rear face, which defines a cable exit by directing the cables at right angles upon exiting the connector housing.

In one aspect of the present invention, one of the connectors is a plug connector which includes alignment posts extending forwardly from the forward or plug portion of the housing at opposed ends, with the alignment posts comprising large diameter semicylindrical shapes having frustoconical leading ends. The mating receptacle connector includes post-receiving channels at corresponding opposed ends of the forward or hood portion of the housing within which are disposed the array of blade-shaped contact sections of the flat power cable terminals. As the frustoconical leading ends of the alignment posts enter the corresponding post-receiving channels and bear against the hood wall leading edges defining the channel entrances, one of the connectors which is float mounted is gradually urged into alignment with the other which is commonly fixedly mounted, and after proper alignment is achieved the blade-shaped contact sections enter into engagement with the corresponding arrays of spring arm contact sections of the plug connector.

In another aspect of the invention, polarizing channels or keyways extend axially along the outside surfaces of plug housing sides defined by the alignment posts in an asymmetric arrangement, for receipt of corresponding polarizing ribs or keys extending axially along inside surfaces of the hood wall of the receptacle housing. The polarizing keys enter the polarizing keyways after the connectors have become axially and angularly aligned, if the connectors have been oriented into the appropriate angular or polarized orientation. To prevent mating if the connectors are not properly oriented, short channel segments or blind keyways are defined into the frustoconical alignment post leading ends symmetrically opposed from the polarizing channels, whereinto the leading ends of the polarizing keys enter until abutting the ends of the blind keyways prior to contact engagement and assuredly stopping further connector movement, whereafter the connectors can be separated and then properly oriented and then mated.

In yet another aspect of the invention, one embodiment of self-aligning connector assembly includes a latching system compatible with the alignment system. The receptacle connector includes a rear cover member which includes a pair of opposing latch arms extending forward along both sides of the receptacle housing with forward free ends of the latch arms including inwardly directed latch projections defining rearwardly facing latch surfaces. The latch arm free ends extend within slots along ends of the hood section of the receptacle housing such that the latch projections extend inwardly into the large cavity defined by the hood section and are adapted to be deflected outwardly. The plug connector includes latching recesses positioned along outer surfaces of the alignment posts spaced rearwardly from the leading ends thereof; upon mating the alignment posts extend into the post-receiving recesses of the hood section, and the latch projections bear against the alignment posts and result in the latch arms being initially deflected outwardly thereby; and eventually the latching projections latch into the latching recesses when the connectors are urged completely together in mated condition.

In yet another aspect of the invention, the blade-shaped contact sections include a polarizing feature permitting assembly into the receptacle connector housing in only one orientation in cooperation with a respective polarizing feature along the respective cavity of the housing, to assure proper assembly for ultimate proper electrical connection with the corresponding terminals of the mating connector, since one conductor of a dual conductor cable can be positive and the other negative. The plug connector is also adapted to receive the polarizing features of the blade-shaped contact sections of the terminals. The polarizing feature can be an angled lance at the blade leading end which must be positioned and angled not to interfere with engagement with a spring arm of the corresponding terminal upon mating.

In still another aspect of the invention, the strain relief member on each flat cable connector includes pairs of U-shaped bosses spaced apart laterally just wider than the width of a cable conductor and extending from a transverse body section forwardly toward each flat power cable terminal within the housing and beside the lateral edges of the flat cables, within which are disposed rearward bight sections or hinges of the terminals. This arrangement centers the outer sides of the rearward ends of the terminals and in cooperation with the housing cavities forwardly thereof tends to basically axially align in three dimensions the terminals and the blade-shaped contact sections extending forwardly from the cavities. This arrangement also maintains the rearward terminal ends in a centered position when the flat cables are strained at right angles to the connector and contact terminals therein, which would otherwise tend to urge the terminal rearward ends out of position and would also otherwise tend to degrade the integrity of the termination of each terminal to the respective cable conductor.

The connectors can be adapted to be rack and panel connectors by one thereof being fixedly mounted such as to the rear face of a power supply while the other thereof is float mounted to the framework of a card cage, with the connectors held together in fully mated condition by fastening means on the framework and power supply. The connectors can also include a latching arrangement to be latched together upon being mated by hand, which permits manual delatching and unmating.

It is an objective of the present invention to provide a matable connector assembly suitable for terminations of flat power cable, having integral means to achieve self-alignment prior to electrical engagement of the mating contacts thereof.

It is another objective to provide such a connector assembly with integral polarizing means compatible with the self-alignment means thereof, and to also provide assured means of preventing mating of connectors which are not properly angularly oriented even if aligned.

It is an additional objective to provide such a connector assembly with integral means to attain precise alignment of wide blade-shaped contact sections of the terminals of one of the connectors with correspondingly wide arrays of spring arm contact sections of the mating connector exposed to matingly engage the blades, by utilizing stabilizing ribs in the blade-receiving cavities of the mating connector, while stabilizing the location and orientation of the spring arms of the mating connector terminals by positioning the stabilizing ribs beside and opposing each spring arm and recessing the spring arm free ends rearward of rib leading ends for safety reasons and for protection from damage during mating and also when unmated.

It is yet another objective of the present invention to assure that the contact terminals terminated to the flat power cables are positioned and oriented properly within the receptacle connector housing and maintained in such proper position and orientation after assembly both during mating and when subjected to a moment arm from cable strain at the rearward terminal ends, while permitting incremental movement of the blade-shaped contact sections at the forward ends thereof for precise alignment during mating.

Embodiments of the present invention will now be described by way of example with reference to the accompanying drawings.

DETAILED DESCRIPTION OF THE PREFERRED EMBODIMENTS

Figure 1:
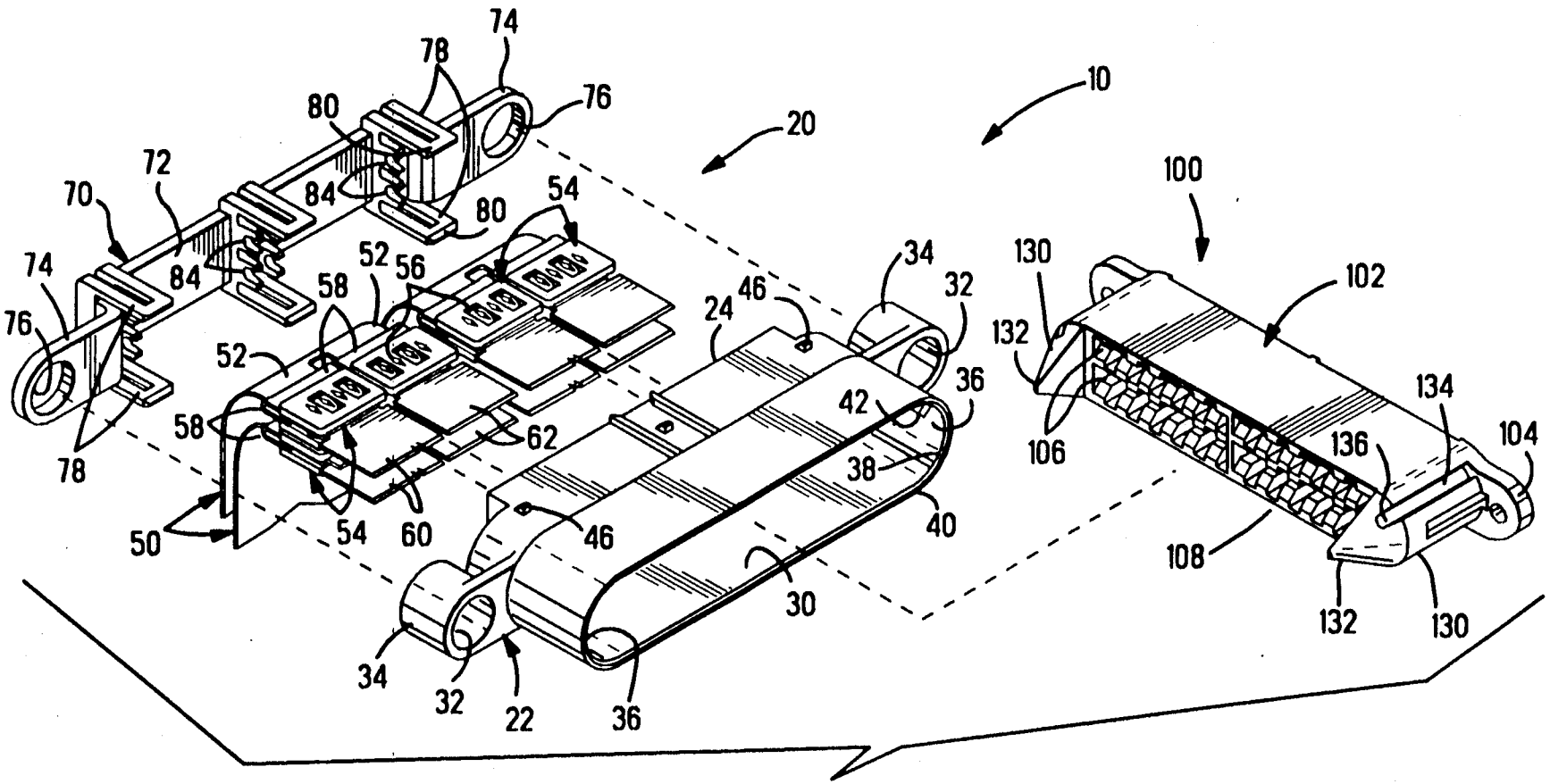
FIG. 1 is an isometric view of a plug connector header matable with a receptacle connector, with flat power cable terminations exploded rearwardly from the receptacle connector and a strain relief member exploded therebehind.
Figure 2:
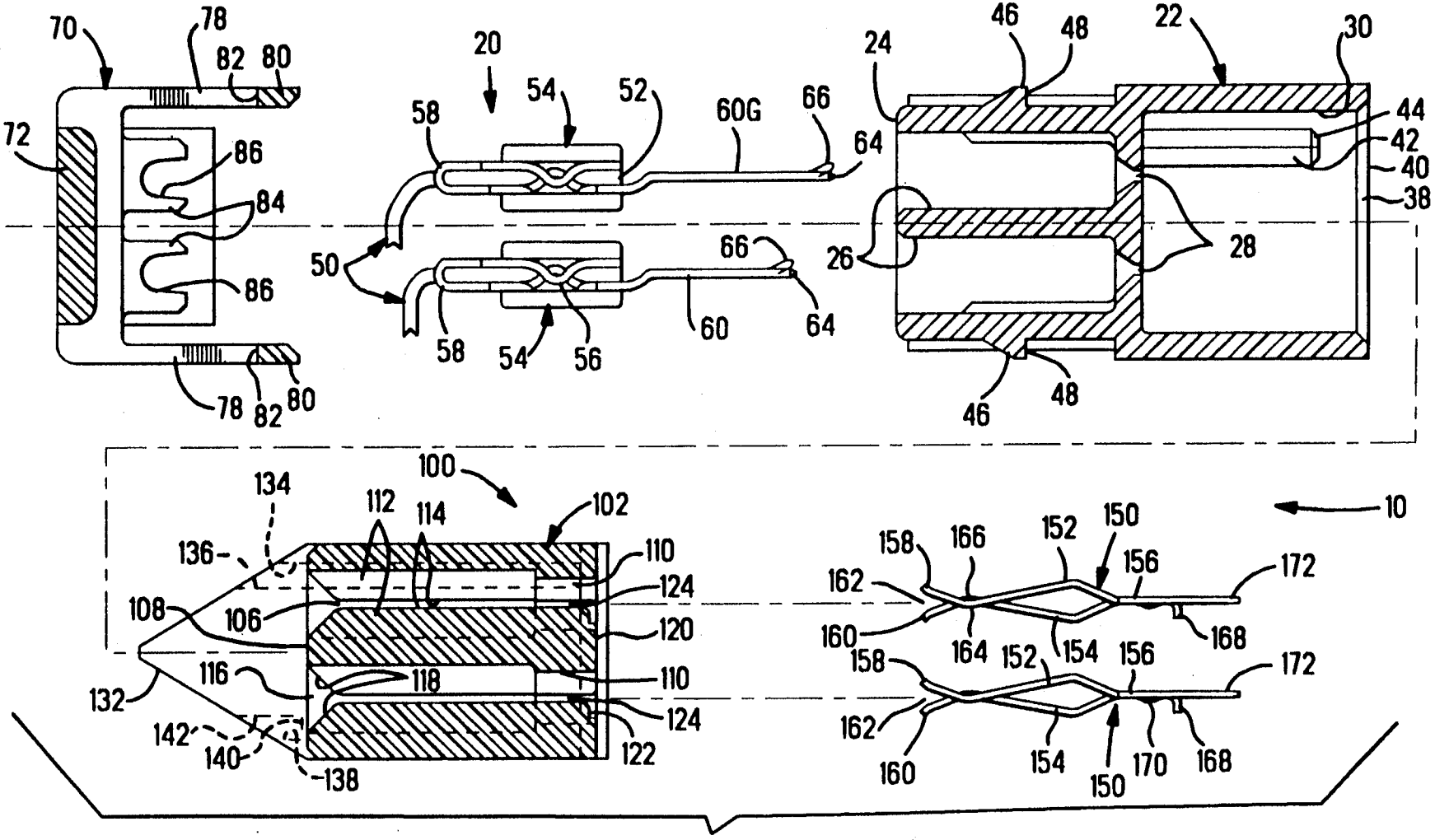
FIGS. 2 and 3 are longitudinal section views of the plug and receptacle connectors of FIG. 1 with the components thereof shown assembled in FIG. 3.
Figure 3:
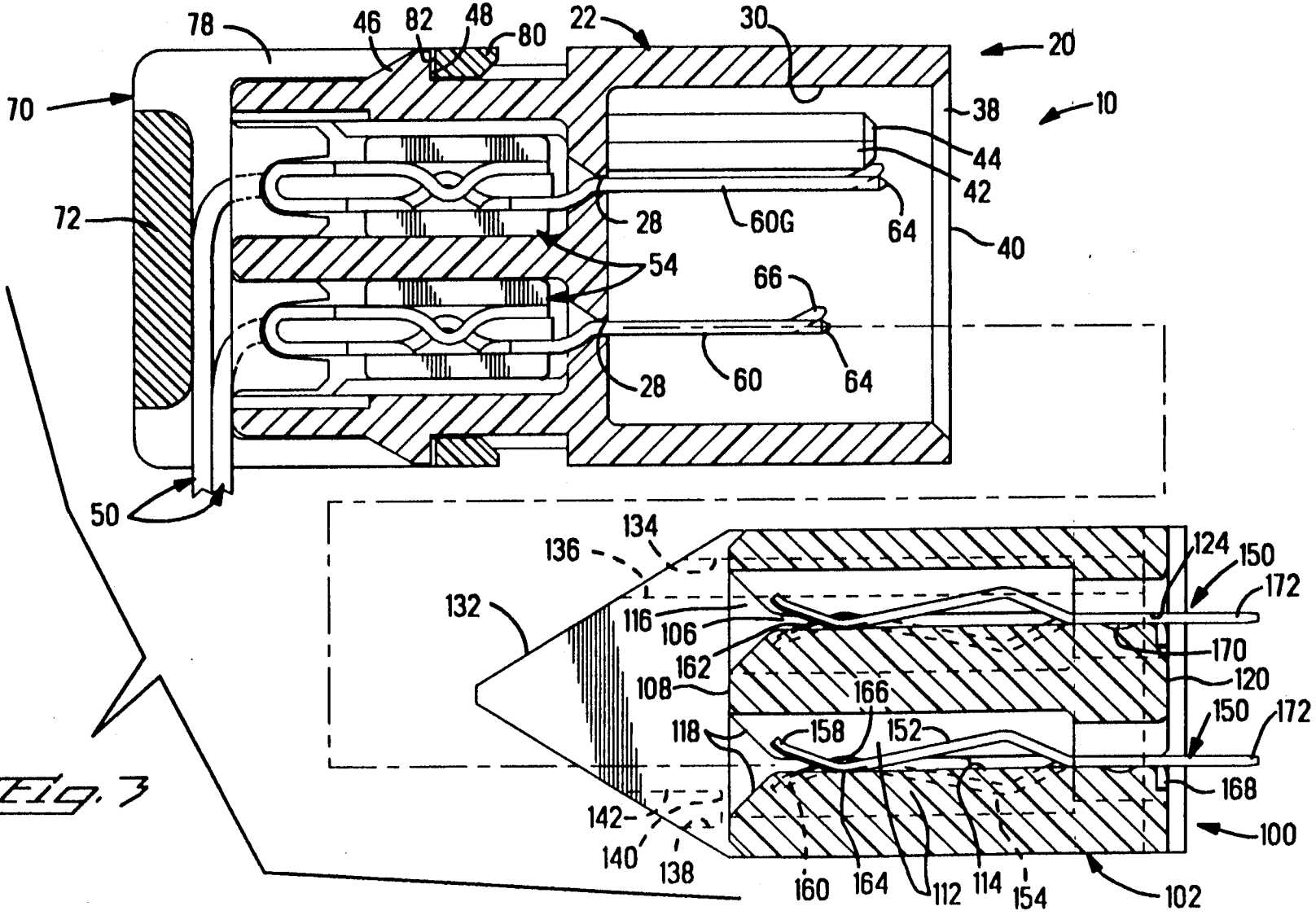

FIG. 1 illustrates the matable connector assembly 10 of a cable connector 20 and a mating header 100, and FIGS. 2 and 3 illustrate the various parts and the assembly thereof. Cable connector 20 includes a receptacle type housing 22 of dielectric material and a dielectric cable strain relief rear cover 70 latchable onto rearward face 24 of housing 22. Terminal-receiving cavities 26 extend forward from rear face to narrow cavity portions 28 in communication with a large common cavity defined by hood 30. Header 100 has a housing 102 of dielectric material shown to be of the plug type which includes mounting flanges 104 adapted to be mounted fixedly to a printed circuit board or the like, such as mounted along the rear face of a power supply (not shown).

Cable connector 20 is adapted to be mounted by appropriate accessories to a panel such as the framework of a card cage (not shown) at the rear of a power supply-receiving area, to be associated with the rear face of a power supply (not shown) which will then be moved during insertion into the card cage along guides within the cage, in order for cable connector 20 to mate with header 100 mounted on the power supply rear face. Apertures 32 of mounting flanges 34 of housing 22 (and apertures of mounting flanges of strain relief 70 rearwardly thereof) have large diameters so that shoulder bolts (not shown) having shanks of lesser diameter extending therethrough, fasten connector 20 to a panel in a manner permitting incremental lateral movement of the mounted connector with respect to the panel, termed "float mounting", as is generally conventional.

In cable connector 20 four flat cables 50 are shown each having two conductors contained spaced apart within a common insulative jacket (FIGS. 4 and 5), and having respective terminals 54 terminated onto the conductors at tab-shaped cable ends 52. Terminals 54 are of the type disclosed in U.S. Pat. No. 4,915,650 having interlocking arrays of wave shapes across terminating regions 56, and have been staked as disclosed in U.S. Pat. No. 4,859,204 to define a plurality of gas-tight electrical connections with the conductors. Bight sections 58 define tab-receiving slots therebetween through which tab-shaped cable ends 52 are inserted prior to termination in a close fit within the slot, with the cable ends 52 preferably clamped upon termination between the upper and lower portions of the terminal rearward end, as is disclosed generally in U.S Pat. No. 4,915,650.

Upon connector assembly terminated tab ends 52 of each cable 50 are inserted into rearward face 24 of housing 22 so that the terminals enter respective terminal-receiving cavities 26 whereafter cable strain relief 70 is latched to housing 22 securing the terminated cable ends in connector 20. Blade-shaped contact sections 60,62 of terminals 54 extend through narrow forward cavity portions 28 to extend forwardly within the large cavity defined by hood 30 to leading ends 64 which are recessed behind leading edge 40 of hood 30. Leading edge 40 is preferably tapered as at 38 to facilitate receipt of the plug section of header 100 thereinto.

Blade-shaped contact sections 60,62 of cable connector terminals 54 will coextend forwardly within hood 30 and will enter entrances of elongate blade-receiving slots 106 defined along mating face 108 of header housing 102 upon mating, to engage mating terminals 150 housed therewithin in terminal-receiving cavities 110 thereof in communication with slots 106. Header terminals 150 are of the type having wide arrays of opposing offset spring finger contact sections 152,154 extending forwardly from a common body section 156 between which blade-shaped contact sections 60,62 will extend for electrical engagement therewith upon full mating. Connector 20 can be adapted for engagement of a ground circuit prior to a "hot" circuit by providing for the ground one of cables 50 to have terminated thereto a terminal 54 having a longer blade shaped contact section 60G which will be electrically engaged earlier in the connector mating sequence.

As shown in FIGS. 2 and 3, barrier walls or stabilizing ribs 112 alternate on opposed sides of slot 106, and surfaces 114 thereof effectively define slot 106 in a dimension just larger than the thickness of a blade-shaped contact section 60,62. Entrance 116 to blade-receiving slot 106 is defined by angled surfaces 118 comprising leading ends of stabilizing ribs 112, which provides assured lead-in benefits to align the blade-shaped contact sections 60 of terminals 54 during mating by bearing against leading ends 64 if slightly misaligned and then urging the blade-shaped contact sections into appropriate precise alignment for entry into narrow slot 106 and subsequent engagement by terminals 150.

Spring fingers 158,160 of terminals 150 are disposed between adjacent ones of ribs 112 along slot 106. Diverging free ends 158,160 of spring fingers 152,154 together define an elongate blade-receiving aperture 162 axially inwardly of entrance 116 to blade-receiving slot 106. Contact surfaces 164,166 of spring arms 152,154 define blade-engaging portions of terminals 150 at the narrow rearward end of blade-receiving aperture 162 and upon assembly into housing 102 are preferably spring biased against facing surfaces 114 of opposing ones of stabilizing ribs 112. Contact surfaces 164,166 will engage corresponding portions of the now-aligned blade-shaped contact section 60 of a corresponding terminal 54 whereupon the spring arms are deflected away from rib surfaces 114 and become substantially spring biased against blade-shaped contact section 60 generating substantial contact normal force for assured electrical engagement therewith, upon mating.

For assembly of header 100, terminals 150 are inserted into mounting face 120 of housing 102 until stopped by one or more lock tabs 168 engaging behind stop surfaces 122 along mounting face 120. Upon assembly diverging free ends 158,160 are positioned recessed rearwardly from angled surfaces 118 and between adjacent ones of stabilizing ribs 112 providing physical protection therefore against stubbing and stress especially by an otherwise possibly misaligned blade-shaped section upon mating and also providing safety in that header 100 is adapted to pass a standard probe insertion test preventing inadvertent engagement with those of contacts 150 which may be "live"; the spring arm free ends are also protected against inadvertent contact by foreign objects when unmated and exposed. Terminal retention in housing 122 is provided by dimples or bosses 170 creating an interference fit within closely dimensioned rearward portion 124 of terminal-receiving cavity 110. Post sections 172 extend rearwardly from header 100 to be inserted for example into plated through-holes of the printed circuit board (not shown), to establish an electrical connection therewith, such as by soldering or by being formed into stiff compliant springs for a firm interference fit upon insertion into the through-holes as is known.

Consistent with precision alignment of the plurality of relatively large terminals 54 of connector 20, the terminals are disposed in housing 22 in cavities 26 thereof in close fit therein after which rear cover 70 is latched onto the rear of housing 22 to secure the terminals 54 terminated to ends of cables 50 in the housing. Referring to FIGS. 1 to 3, rear cover 70 includes a transverse body portion 72, mounting flanges 74 at each end having large apertures 76 therethrough, and several pairs of latch arms 78 extending forward from side edges of body portion 72 at spaced locations therealong. Each latch arm 78 includes a free end 80 defining a rearwardly facing latching surface 82; latching projections 46 are disposed along side surfaces of housing 22 corresponding to latch arm locations and define forwardly facing latch surfaces 48. Rear cover 70 is latched onto housing 22 from rearwardly thereof as latch arms 78 extend along sides of housing 22, free ends 80 are deflected outwardly to pass over latch projections 46 assisted by angled surfaces, and upon full assembly free ends 80 resile and the latch surfaces 82,48 latchingly engage (FIG. 3). Apertures 76 of flanges 74 are aligned with apertures 32 of mounting flanges 34 of housing 22 so that connector 20 can be float mounted to card cage framework using shoulder bolts of lesser diameter (not shown).

Upon assembly of connector 20, flat wide cables 50 are constrained to exit connector 20 at a right angle at the rearward end by transverse body portion 72 of rear cover 70. Latch arms 78 are located so as to permit cable exit therebetween to either side of rear cover 70 as desired. When rear cover 70 is latched in position, it is adapted to assist in the alignment and positioning of terminals 54 to facilitate connector mating.

Rear cover includes a plurality of U-shaped bosses 84 extending forward from transverse body portion 72 within terminal-receiving cavities 26 of housing 22 beside the lateral edge of each cable. U-shaped bosses define a U-shaped recess 86 adapted to be received around the outer U-shaped bight section 58 of each terminal 54, that is to say the bight section along a lateral outer edge of the cable 50 to which the terminal is terminated. With the outer bight section of each terminal 54 now held in a close fitting U-shaped boss of rear cover 70, and with relatively stiff flat cable 50 holding both terminals on tab-shaped ends 52 relatively coplanar, rearward ends of the terminals 54 are now held centered within cavities 26 as the forward ends are held centered in close fitting cavity portions 28 thus centering and also axially aligning terminals 54 and especially blade-shaped contact sections 60 thereof, although in a manner permitting incremental adjustment during connector mating as the blade-shaped contact sections are precisely aligned upon receipt into entrances 116 of blade-receiving slots 106. U-shaped bosses 84 also provide relief for the terminations such as during alignment of connector 20 during connector mating upon flat cables 50 transmitting strain (and/or torque) at right angles to connector 20 by continuing to hold bight sections 58 at the rearward terminal ends stable and in centered alignment.

It is necessary to assure that the connectors be aligned properly with each other, both axially and angularly, especially since the connectors are to become mated remote from the operator. Header housing 102 includes at each end of the mating face alignment posts 130 which are semicylindrical in cross-section and include leading ends 132 having a frustoconical shape. During initial stages of connector mating, post leading ends 132 enter corresponding post-receiving apertures 36 defined by semicylindrical ends of hood 30 of receptacle connector housing 22, and commonly being misaligned the surfaces of alignment post leading ends 132 engage and bear against tapered edges 38 of leading edge 40 of cable connector housing 22. Such bearing engagement serves to align the orientation of connector housing 22 by incrementally adjusting the position and angular orientation of connector housing 22, since connector 20 is float mounted and is thereby permitted limited lateral movement in the two-dimensional transverse plane. The connectors continue being urged together properly aligned with each other.

Immediately thereafter perpendicular leading ends 44 of polarizing ribs or keys 42 enter into entrances 136 of correspondingly positioned polarizing channels or keyways 134 whereafter the connectors can be fully mated and the electrical terminals enter into appropriate electrical engagement. The entrances 136 occur near the rearward end of the frustoconical leading ends 132 of the alignment posts 130. Were polarizing keys 42 to be positioned on the incorrect side of alignment posts 130 due to improper polarizing orientation of the cable connector 20, the present invention includes a blind passage or false keyway 138 into which a leading key end 44 enters and then firmly abuts against a transverse stop surface 140. Entrance 142 of false keyway 138 occur near the rearward end of the frustoconical leading ends 132 of alignment posts 130 but angularly offset from keyway entrances 136. This arrangement prevents inadvertent full "mating" since the leading key ends come to an abrupt halt rather than the keys tending to be gradually deflected outwardly by the frustoconical alignment post leading ends which would result in their outwardly deforming the wall of hood 30 of connector 20 at both ends if the axially applied mating force were great enough. Such stopping by the abutting transverse surfaces provides a noticeable indication of improper polarization and allows the person mating the connectors to invert one of the connectors, thereby reversing the polarization to attain connector mating.

Figure 4:
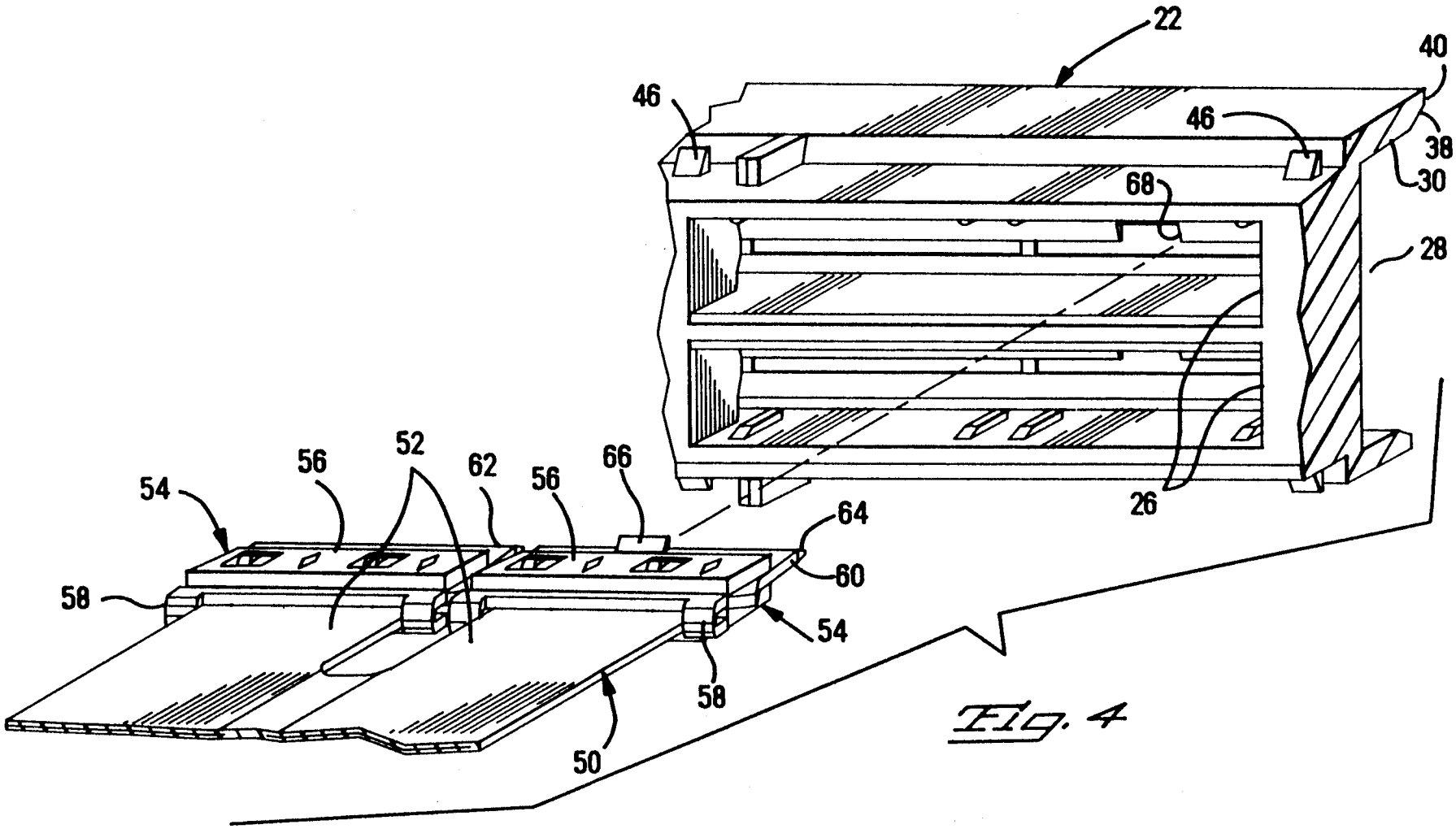
FIGS. 4 and 5 are isometric views of the receptacle connector of FIGS. 1 to 3 having the terminated end of one of the flat cables assembled thereinto in a polarized orientation.
Figure 5:
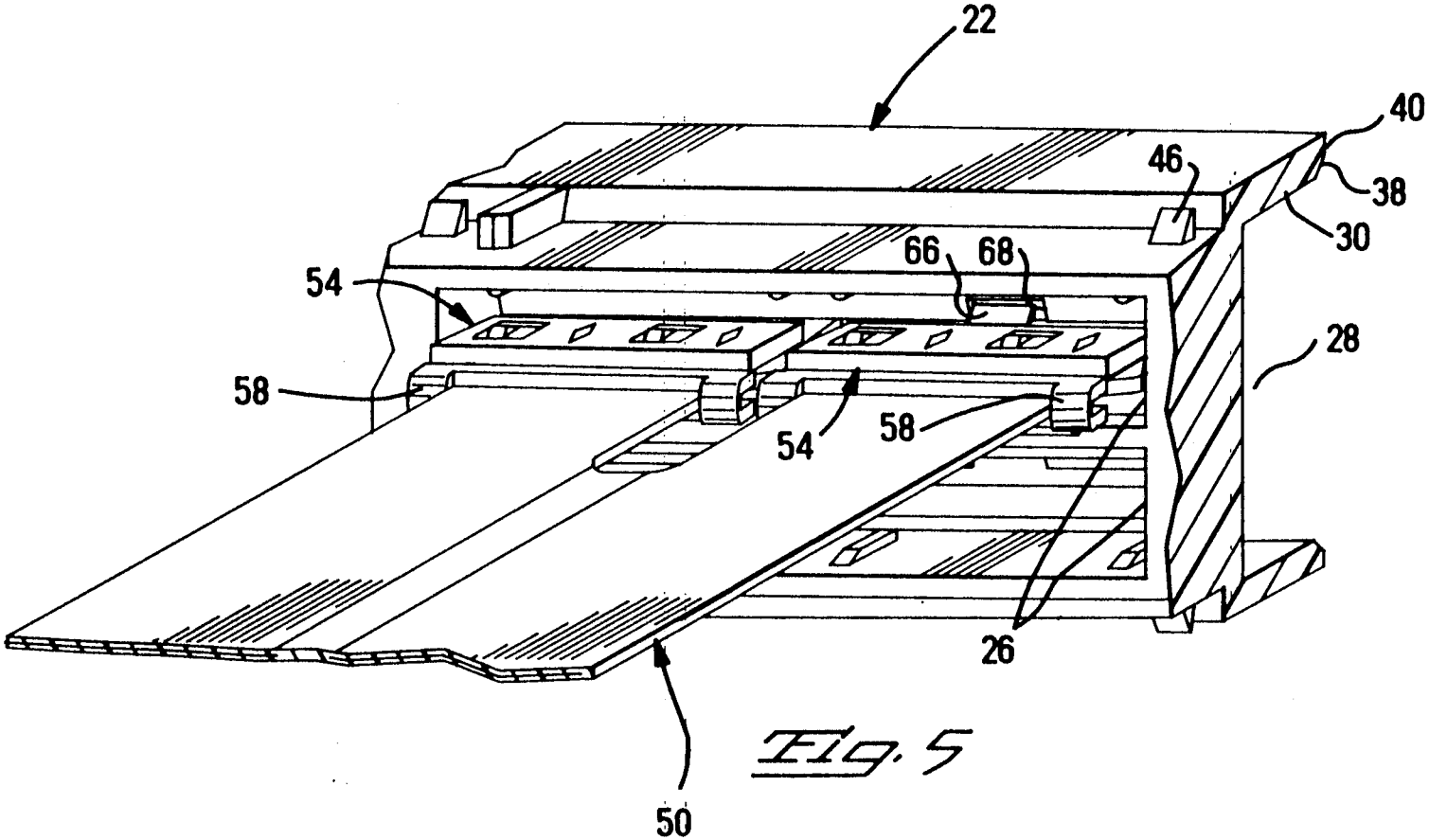

FIGS. 4 and 5 illustrate the polarization mechanism utilized during assembly of connector 20. Each cable 50 may have two conductors of different voltage, such as +70 volts and −70 volts, at 35 amperes for example, and it is necessary to assure that the terminated cable end is inserted into housing 22 in only one orientation. Therefore, each pair of terminals associated with a particular cable 50 include one which includes a polarizing lance 66 protruding out of the plane of the blade-shaped contact section far enough not to pass through narrow forward cavity portion 28. A corresponding channel 68 is defined along cavity portion 28 to permit passage of polarizing lance 66 therethrough when the terminated cable end is oriented in the desired manner so that the appropriate conductor's terminal is to the right or left side of cavity 26 as desired. In the appropriate polarized orientation the appropriate one of terminals 54 is lined up with the corresponding one of terminals 150 with which it is to be electrically connected. Polarizing lance 66 is formed (and channel 68 therefor) at a location not lined up with a spring arm of mating terminal 150, and header 100 is adapted to receive polarizing lance 66 thereinto, by simply not including a full height stabilizing rib 112 at the particular location aligned with lance 66. The integrity of the electrical connections between connector 20 and header 100 is thus maintained.

Figure 6:
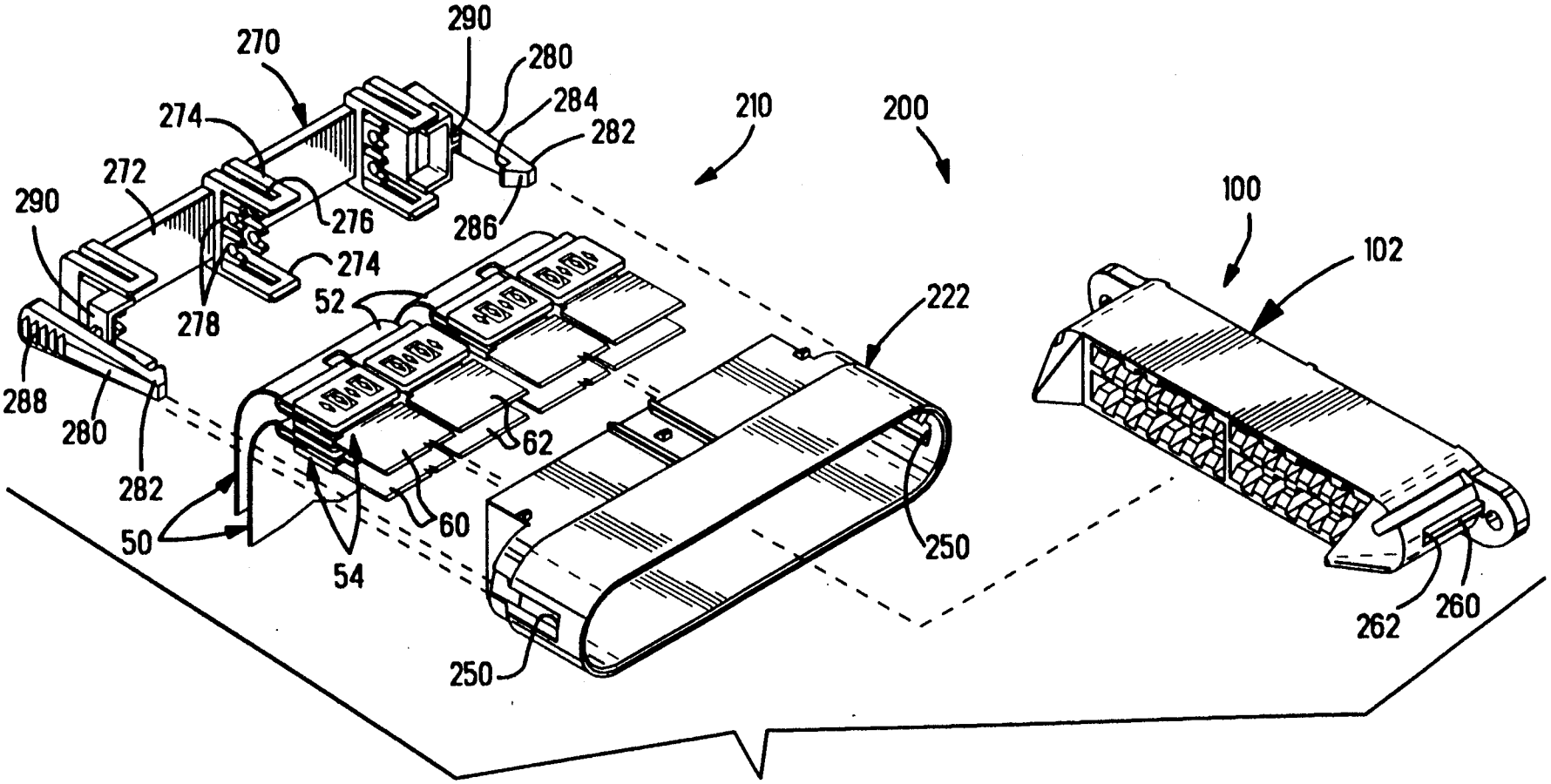
FIG. 6 is an exploded unmated view of an alternate embodiment of the self-aligning connector assembly of the present invention, adapted to be latched together in mated condition.
Figure 7:
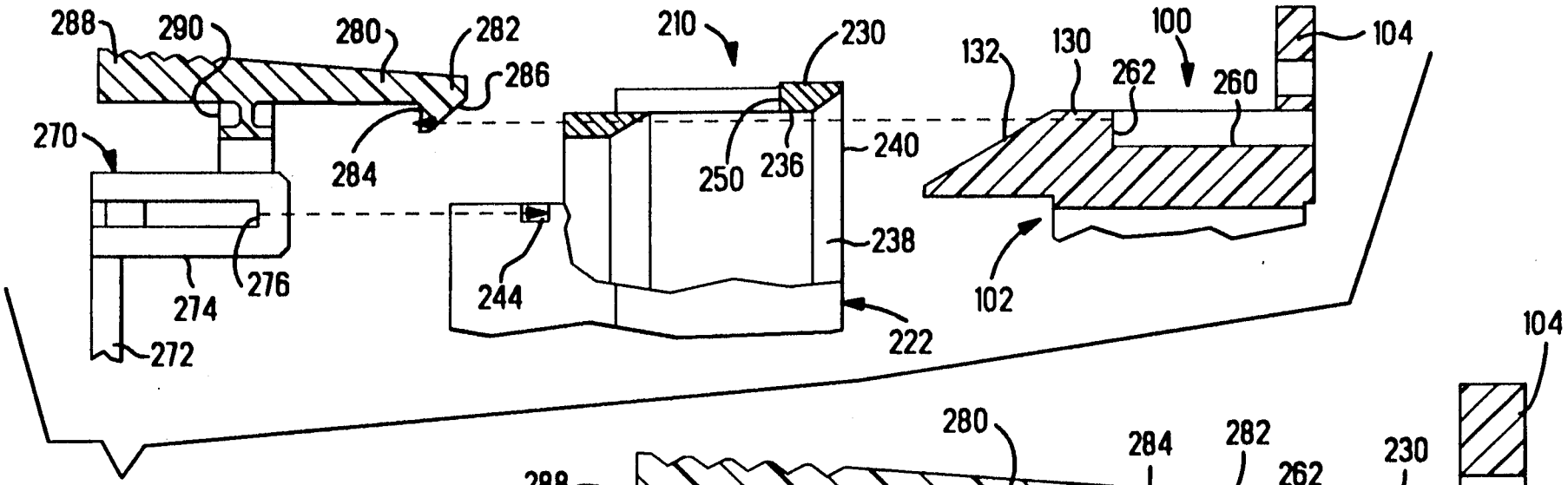
FIGS. 7 and 8 are enlarged longitudinal section views of the latching arrangement of the connectors of FIG. 6.
Figure 8:
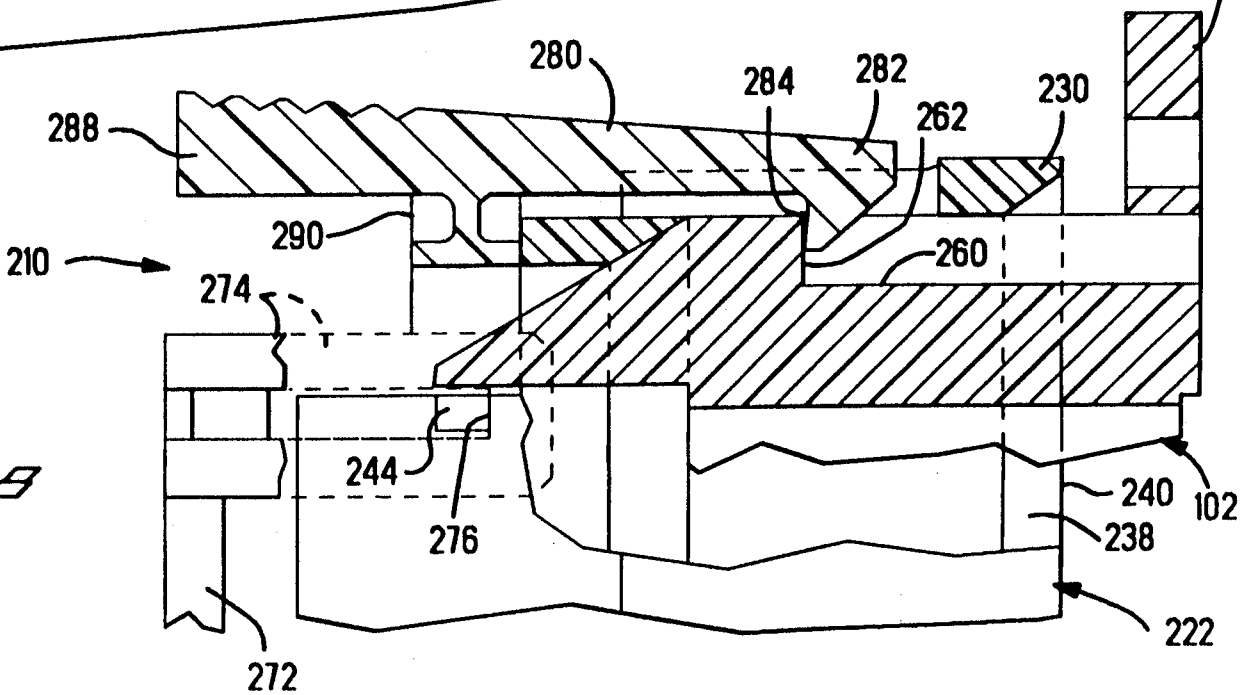

Another embodiment of self-aligning connector assembly 200 of the present invention is illustrated in FIGS. 6 to 8, in which the cable connector 210 is adapted to be latched to header 100, which can be the same header as would mate with cable connector 20 of FIGS. 1 to 5. Cable connector 210 is adapted to be mated manually to header 100 and latch therewith in a manner permitting delatching and unmating as desired. Rear cover 270 includes a transverse body portion 272, an array of pairs of latch arms 274 having free ends 276 for being secured to housing 222, and U-shaped bosses 78 for terminal stabilization, as in rear cover 70 of FIGS. 1 to 3. A pair of latch arms 280 extend forwardly from lateral ends of rear cover 270 to free ends 282 which extending laterally inwardly to define rearwardly facing latch surfaces 284. Free ends 282 include tapered surfaces 286 facing forwardly and inwardly to assist both in assembly of connector 210 and in mating with header 100, by initiating outward deflection of latch arm 280. Each latch arm 280 includes a manually grippable rearward section 288 to be pivoted inwardly about hinge joint 290 to rotate the forward free end 282 outwardly to delatch for unmating.

Connector housing 222 is dissimilar to housing 22 of FIGS. 1 to 5 only in the absence of mounting flanges and the presence of elongate apertures 250 through hood 230. Rear cover 270 is securable to housing 222 from rearwardly thereof with forward ends 276 of latch arms 274 latching forwardly of latch projections 244. During assembly latch arm free end 282 is deflectable outwardly to pass over the rear portion of hood 230, and free end 282 resiles inwardly to extend through elongate aperture 250 and partially into the large cavity defined by hood 230. Header 100 includes an elongate channel 260 along the outer surface of alignment post 130, rearward from rearwardly facing latch surface 262. After frustoconical alignment post leading end 132 has entered post-receiving recess 236 of hood 230 during initial stages of mating of properly polarized connectors 210,100, latch arm free end 282 is again deflected outwardly when bearing against the surface of frustoconical alignment post leading end, and resiles into channel 260 of header 100 to latch connectors 210, 100 together in fully mated condition with latch surface 284 adjacent channel surface 262. Inward deflection of manually grippable rearward latch arm sections 288 rotates free end 282 outwardly to delatch latch arm 280 from header 100 for unmating. Latch arm joint 290 is preferably of the robust, durable design disclosed in U.S. Pat. No. 4,944,693.

The specific embodiments disclosed herein are exemplary, and modifications can be made thereto in various ways in keeping with the principles of the present inventions claimed herein. Other embodiments of self-aligning flat power cable connectors can be devised which are within the scope of the claims and the spirit of the invention.

What is claimed is:

1. An electrical connector assembly for connecting a plurality of flat power cables each having a pair of flat conductors, with another electrical conductive means along a separable mating interface, comprising:

a first connector having a dielectric first housing including a plurality of first terminal-receiving cavities in communication with a mating face and a hood section forwardly of said mating face, said first connector further having a plurality of first electrical terminals terminated onto ends of respective flat conductors of said plurality of flat power cables and disposed in respective said first terminal-receiving cavities and including wide blade-shaped contact sections extending forwardly of said mating face and within said hood section to leading ends recessed behind a leading edge of said hood section, and said first connector further including a dielectric rear cover member securable onto a rearward face of said first housing after said first terminals have been disposed therein in a manner permitting said plurality of flat power cables to exit said first housing;

a second connector having a dielectric housing including a plurality of second terminal-receiving cavities in communication with a mating face at a forward end of a plug section thereof, said plug section adapted to be received into said hood section of said first connector housing, said second connector further including a plurality of second electrical terminals secured in respective said second terminal-receiving cavities, said second terminals including wide forward contact sections adapted to be electrically engaged with said blade-shaped contact sections of said first terminals upon mating of said first and second connectors, and said second terminals further including rearward contact sections at least exposed along a rearward face of said second housing to be electrically engaged with corresponding conductor means of another electrical article;

at least one of said first and second connectors being mounted on another article in a manner permitting limited transverse movement with respect thereto;

said second housing including blade-receiving apertures into said mating face thereof adapted to receive said blade-shaped contact sections of said first terminals during intermediate stages of connector mating and to engage with and align leading ends of said blade-shaped contact sections; and said first connector including means for engaging said first terminals terminated onto said respective flat cables proximate respective rearward terminal ends and at said mating face proximate base portions of said blade-shaped contact sections to center and stabilize said first terminals in an axially aligned orientation in a manner permitting incremental adjustment of said blade-shaped contact sections upon receipt into corresponding said blade-receiving apertures of said second connector just prior to electrical engagement of said contact sections of said first and second terminals during mating.

2. The electrical connector assembly as set forth in claim 1 wherein said means for engaging said rearward terminal ends comprise U-shaped bosses extending forwardly from a transverse body section of said rear cover to retain rearward bight sections of said first terminals adjacent lateral edges of said respective flat cables.

3. The electrical connector assembly as set forth in claim 2 wherein said transverse body section of said rear cover is spaced from rearward edges of said first housing along said rearward face thereof to define cable exits extending perpendicularly to axes of said first terminal-receiving cavities, and said U-shaped bosses provide said first terminal rearward ends with relief from strain applied by said flat cables otherwise tending to urge said first terminal rearward ends out of alignment.

4. An electrical connector assembly for connecting a plurality of electrical conductor cables, with another electrical conductive means along a separable mating interface, comprising:

a first connector having a dielectric first housing including a plurality of first terminals secured within first terminal-receiving cavities and including first contact sections extending forwardly of a housing mating face and within a hood section of said first housing to leading ends recessed behind a leading edge of said hood section;

a second connector having a dielectric housing including a plurality of second terminals secured within second terminal-receiving cavities and including second contact sections positioned within a plug section of said second housing and exposed along a mating face thereof and adapted to be electrically engaged with said contact sections of said first terminals upon mating of said first and second connectors, said plug section adapted to be received into said hood section of said first connector housing;

at least one of said first and second connectors being mounted on another article in a manner permitting limited transverse movement with respect thereto, and said first and second connectors including cooperable means for precisely aligning said first and second housings thereof during initial stages of connector mating by urging at least said one of said first and second connectors incrementally transversely upon cooperative engagement of said cooperable alignment means, thereby aligning said contact sections of corresponding ones of said first and second terminals prior to engagement therebetween;

said first and second housings further including cooperable polarizing means, said first housing including polarizing keys selectively positioned angularly about said hood section and extending axially along inside surfaces thereof rearwardly from a substantially transverse leading end recessed from a leading edge of said hood section, and said second housing including keyways defined axially along outside surfaces of said plug section rearwardly from a leading edge thereof and selectively positioned angularly thereabout corresponding to said polarizing keys of said first housing to permit connector mating upon proper polarizing orientation thereof; and said second housing further having blind keyways extending partially along said outside surfaces of said plug section from a leading edge thereof and selectively positioned angularly thereabout to initially receive thereinto said leading ends of said polarizing keys of said first housing during initial mating stages upon improper polarizing orientation thereof, said blind keyways including substantially transverse rearward ends defining stop surfaces positioned closely to said keyway entrances to assuredly prevent further movement of said first and second connectors toward each other and assuredly indicate improper polarizing orientation prior to engagement said first and second terminals.

5. The electrical connector assembly of claim 4 wherein said second housing includes at least a pair of alignment projections extending forwardly of said mating face thereof to frustoconical leading ends defining bearing surfaces, and said hood section of said first housing includes projection-receiving recesses defined along inside surfaces thereof and extending inwardly from said leading edge thereof adapted to receive thereinto and therealong respective said alignment projections of said second housing upon mating of said first and second connectors, said bearing surfaces engageable with portions of said hood leading edge during initial stages of connector mating to urge said at least one of said first and second connectors incrementally transversely to precisely align said first and second connectors prior to engagement of said first and second terminals during later stages of connector mating; and said polarizing keys are defined along said projection-receiving recesses of said hood section, and said polarizing keyways and said blind keyways are defined along said alignment projections with said entrances thereof defined on said frustoconical leading ends thereof.

6. An electrical connector assembly comprising:

a plug connector including a plug housing having a forward plug portion and a receptacle connector including a receptacle housing having a forward hood section adapted to receive said plug portion thereinto during connector mating, and at least said receptacle connector having a rear cover member securable onto the rear face of said receptacle housing;

said rear cover including a pair of latch arms adapted to coextend partially along opposing sides of said receptacle housing upon connector assembly, each said latch arm including a forward free end including an inwardly directed latching projection, and each said latch arm adapted to be deflectable outwardly at said free end;

said receptacle housing including apertures through said opposing sides thereof in communication with a large plug-receiving cavity defined by said forward hood portion, and said latching projections of said latch arm free ends extending inwardly through said apertures and partially into said plug-receiving cavity; and said plug housing including channels along sides thereof corresponding to said sides of said receptacle housing and aligned with said latch arms, and extending rearwardly from a rearwardly facing latching surface at a location spaced rearwardly from a leading edge of said forward plug portion of said plug housing, whereby said latching projections of said latch arm free ends of said receptacle housing are adapted to resile into said plug housing channels rearwardly of said latching surfaces and latch said plug connector and receptacle connector together upon mating thereof while not substantially increasing the width of said receptacle connector nor extending forwardly thereof.

7. An electrical connector assembly as set forth in claim 6 wherein said latch arms each include manually grippable sections rearwardly of a hinge about which said latch arm is rotatable during deflection, enabling inward deflection of said manually grippable section to pivot said forward latch arm free end outwardly to delatch said receptacle connector from said plug connector for unmating.

8. An electrical connector assembly for connecting a plurality of flat power cables each having a pair of flat conductors, with another electrical conductive means along a separable mating interface, comprising:

a first connector having a dielectric first housing including a plurality of laterally adjacent pairs of first terminal-receiving cavities in communication with a mating face and a hood section forwardly of said mating face, said first connector further having a plurality of first electrical terminals terminated in laterally adjacent pairs onto ends of respective flat conductors of said plurality of flat power cables with one of each pair of terminals being terminated onto a selected one of said pair of conductors of a respective said flat cable, said first electrical terminals being disposed in respective said first terminal-receiving cavities and including wide blade-shaped contact sections extending forwardly of said mating face and within said hood section to leading ends recessed behind a leading edge of said hood section, and said first connector further including a dielectric rear cover member securable onto a rearward face of said first housing after said first terminals have been disposed therein in a manner permitting said plurality of flat power cables to exit said first housing;

a second connector having a dielectric housing including a plurality of second terminal-receiving cavities in communication with a mating face at a forward end of a plug section thereof, said plug section adapted to be received into said hood section of said first connector housing, said second connector further including a plurality of second electrical terminals secured in respective said second terminal-receiving cavities, said second terminals including wide forward contact sections adapted to be electrically engaged with said blade-shaped contact sections of said first terminals upon mating of said first and second connectors, and said second terminals further including rearward contact sections at least exposed along a rearward face of said second housing to be electrically engaged with corresponding conductor means of another electrical article;

each said pair of first electrical terminals containing a polarizing projection at least proximate the forward end of one of said blade-shaped contact sections associated with a selected one of said pair of conductors of said flat cable, and one of each said pair of terminal-receiving cavities including a corresponding polarizing means cooperable with said polarizing projection of said one contact section to permit complete insertion of said terminated cable end into said housing by permitting said one contact section to be fully inserted through said respective terminal-receiving cavity when said terminated cable end has been positioned in an appropriately polarized orientation prior to assembly while complete insertion of said terminated cable end into said first housing is prevented when said terminated cable end has not been appropriately polarized by disallowing said one contact section to be inserted into the noncorresponding one of said pair of terminal-receiving cavities not containing a polarizing means corresponding to said polarizing projection, whereby said terminals terminated onto respective said conductors of said flat cable can be secured in said first housing in only one desired arrangement for said conductors to be electrically connected to appropriate conductive means upon mating of said first and second connectors.

9. An electrical connector assembly as set forth in claim 8 wherein said polarizing projection is a lance formed on a leading edge of said one blade-shaped contact section to extend at an angle forwardly and in a selected direction laterally far enough to create a local terminal width larger than the corresponding general width of a said terminal-receiving cavity, and said polarizing means is a channel of said one terminal-receiving cavity aligned with said lance and deep enough to permit passage of said lance during insertion of said one contact section through said one terminal-receiving cavity.

10. An electrical connector assembly as set forth in claim 8 wherein said polarizing projection is located in a position not associated with a corresponding portion of a mating one of said second electrical terminals upon connector mating, and said second housing is adapted to receive said one blade-shaped contact section thereinto without interference.

* * * * *